US010816283B2

(12) United States Patent
Kusano et al.

(10) Patent No.: US 10,816,283 B2
(45) Date of Patent: Oct. 27, 2020

(54) HEAT EXCHANGER, HEAT EXCHANGE METHOD USING HEAT EXCHANGER, HEAT TRANSPORT SYSTEM USING HEAT EXCHANGER, AND HEAT TRANSPORT METHOD USING HEAT TRANSPORT SYSTEM

(71) Applicant: TOYOTA JIDOSHA KABUSHIKI KAISHA, Toyota-shi. Aichi-ken (JP)

(72) Inventors: Yuya Kusano, Susono (JP); Seiji Yamashita, Gotenba (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 204 days.

(21) Appl. No.: 15/901,057

(22) Filed: Feb. 21, 2018

(65) Prior Publication Data

US 2018/0245863 A1 Aug. 30, 2018

(30) Foreign Application Priority Data

Feb. 24, 2017 (JP) ..... 2017-033753

(51) Int. Cl.
*F28F 13/08* (2006.01)
*F28F 13/14* (2006.01)
(Continued)

(52) U.S. Cl.
CPC ..... *F28F 13/08* (2013.01); *F28D 15/02* (2013.01); *F28F 1/40* (2013.01); *F28F 3/027* (2013.01);
(Continued)

(58) Field of Classification Search
CPC ..... F28D 15/02; F28D 15/0266; F28F 13/14; F28F 13/18; F28F 13/182; H05K 7/20;
(Continued)

(56) References Cited

U.S. PATENT DOCUMENTS 3,613,779 A * 10/1971 Brown ..... F28D 5/00 165/96
4,393,663 A * 7/1983 Grunes ..... F28D 15/0266 165/104.21
(Continued)

FOREIGN PATENT DOCUMENTS

CN 102640298 A 8/2012
CN 102834688 A 12/2012
(Continued)

OTHER PUBLICATIONS

Amy Rachel Betz, James Jenkins, Chang-Jin 'CJ' Kim, Daniel Attinger: "Boiling Heat Transfer on Superhydrophilic, Superhydrophobic, and Superbiphilic Surfaces," Submitted on Nov. 7, 2012.

*Primary Examiner* — Frantz F Jules
*Assistant Examiner* — Erik Mendoza-Wilkenfel
(74) *Attorney, Agent, or Firm* — Sughrue Mion, PLLC

(57) ABSTRACT

A heat exchanger is configured to perform heat exchange by boiling a liquid by heat transfer from a heat source to the liquid through a heat transfer member. In the heat exchanger, a first heat conduction region and a second heat conduction region are alternately provided in a form of stripes on a surface on a side that contacts the liquid such that the liquid boils via a heat transfer member.

18 Claims, 4 Drawing Sheets

(51) Int. Cl.

| | |
|---|---|
| ***F28D 15/02*** | (2006.01) |
| ***F28F 13/18*** | (2006.01) |
| ***F28F 1/40*** | (2006.01) |
| ***F28F 3/02*** | (2006.01) |
| *F28F 1/42* | (2006.01) |

(52) U.S. Cl.
CPC ..... *F28F 13/14* (2013.01); *F28F 13/187* (2013.01); *F28F 1/426* (2013.01)

(58) Field of Classification Search
CPC ..... H05K 7/203; H05K 7/20236; H05K 7/20336; H05K 7/20381; G06F 1/20; G06F 1/203; G06F 1/206
See application file for complete search history.

(56) References Cited

U.S. PATENT DOCUMENTS

| | | | | |
|---|---|---|---|---|
| 5,660,917 | A | 8/1997 | Fujimori et al. | |
| 6,698,500 | B2 | 3/2004 | Noda et al. | |
| 2006/0213211 | A1* | 9/2006 | Shah | H01L 23/427 62/259.2 |
| 2010/0132404 | A1 | 6/2010 | Shuja | |
| 2010/0143619 | A1 | 6/2010 | Yang | |
| 2012/0213882 | A1 | 8/2012 | Inoue | |
| 2013/0025826 | A1 | 1/2013 | Sakamoto et al. | |
| 2016/0238323 | A1* | 8/2016 | Jones | F28F 3/025 |
| 2016/0341488 | A1* | 11/2016 | Wan | F28D 15/0266 |

FOREIGN PATENT DOCUMENTS

| | | | | | |
|---|---|---|---|---|---|
| CN | 203704458 | U | | 7/2014 | |
| GB | 1069535 | A | * | 5/1967 | F22B 37/02 |
| JP | 2008-157589 | A | | 7/2008 | |
| KR | 10-1164611 | B1 | | 7/2012 | |
| WO | 2010/032894 | A1 | | 3/2010 | |
| WO | 2011122332 | A1 | | 10/2011 | |

* cited by examiner

HEAT EXCHANGER, HEAT EXCHANGE METHOD USING HEAT EXCHANGER, HEAT TRANSPORT SYSTEM USING HEAT EXCHANGER, AND HEAT TRANSPORT METHOD USING HEAT TRANSPORT SYSTEM

CROSS-REFERENCE TO RELATED APPLICATIONS

The disclosure of Japanese Patent Application No. 2017-033753 filed on Feb. 24, 2017 is incorporated herein by reference in its entirety.

BACKGROUND

1. Technical Field

The present disclosure relates to a heat exchanger, a heat exchange method using the heat exchanger, a heat transport system using the heat exchanger, and a heat transport method using the heat transport system.

2. Description of Background Art

A heat exchanger may be configured to perform heat exchange by boiling a heat medium. There have been attempts to further increase heat transfer efficiency by forming grooves, or the like, in a heat transfer member for transferring heat from a heat source to the heat medium.

For example, Japanese Unexamined Patent Application Publication No. 2008-157589 (JP2008-157589 A) mentions a pipe that has an inner surface on which a plurality of grooves is formed, and in which heat is exchanged between a fluid that flows inside the pipe and an outside of the pipe. Inside the pipe, an irregular portion, for facilitating boiling of the fluid, is formed on at least one side surface and bottom surface of a groove.

SUMMARY

JP2008-157589 A relates to a technology for facilitating boiling of a fluid, serving as a heat medium, by enabling bubbles to be easily generated based on formed grooves and irregularities on the inner surface of the pipe which is a heat transfer member.

However, according to theoretical calculation, facilitating boiling of the fluid that serves as the heat medium and controlling bubbles generated due to the boiling are factors in improving a coefficient of heat transfer from a heat source to the heat medium in a heat exchanger that uses boiling of the heat medium. Control of bubbles refers to, for example, control of locations and/or positions at which the bubbles are generated, diameters of the generated bubbles, the number of generated bubbles, a generation frequency of the bubbles, and/or the like.

There are many reported examples regarding facilitating boiling as disclosed in, for example, JP2008-157589 A. However, control of the bubbles is considered to be difficult, and there has been little research on improvement of a heat transfer coefficient including control of bubbles.

Some example embodiments of the present disclosure provide a heat exchanger by which bubbles generated due to boiling of a heat medium are controlled, thereby improving a coefficient of heat transfer from a heat source to the heat medium, a heat exchange method using the heat exchanger, a heat transport system using the heat exchanger, and a heat transport method using the heat transport system.

The present disclosure is as follows.

According to an example embodiment of the present disclosure, a heat transfer member may be interposed between a heat source and a liquid to permit heat exchange from the heat source to the liquid. The heat transfer member may include a first heat conduction region and a second heat conduction region that are alternately provided in a form of stripes on a surface of the heat transfer member that is configured to contact the liquid. A first thermal conductivity of the first heat conduction region may be greater than a second thermal conductivity of the second heat conduction region.

A width of a stripe of the first heat conduction region, on the surface of the heat transfer member, may be between 2.5 millimeters (mm) and 7.5 mm.

A width of a stripe of the second heat conduction region, on the surface of the heat transfer member, may be between 0.1 mm and 1.0 mm.

A value of the second thermal conductivity, of a second heat conductive material, of the second heat conduction region may be less than 0.02 times another value of the first thermal conductivity, of a first heat conductive material, of the first heat conduction region.

The heat transfer member may include a first heat conductive material, and the second heat conduction region may include a second heat conductive material and may be embedded in the surface of the heat transfer member that is configured to the liquid.

The heat exchanger may include a liquid supply port to supply the liquid to the surface of the heat transfer member that is configured to contact the liquid, a container to accommodate the liquid and permit the liquid to boil, and a gas discharge port to discharge, from the container, a gas that is generated based on boiling of the liquid.

According to another example embodiment of the present disclosure, a method may include performing, by a heat transfer member that is interposed between a heat source and a liquid, heat exchange from the heat source to the liquid. The heat transfer member may include a first heat conduction region and a second heat conduction region that are alternately provided in a form of stripes on a surface of the heat transfer member that contacts the liquid. A first thermal conductivity of the first heat conduction region may be greater than a second thermal conductivity of the second heat conduction region.

A temperature of the first heat conduction region in the heat exchanger may be greater than a boiling point of the liquid at a pressure inside the heat exchanger. A temperature difference between the temperature of the first heat conduction region and the boiling point of the liquid may be greater than or equal to 10° C.

The liquid may be at least one of water or a fluorine-based solvent.

The heat source may be a gas.

According to another example embodiment of the present disclosure, a heat transport system may include a heat exchanger that may include a heat transfer member that is interposed between a heat source and a liquid to permit heat exchange from the heat source to the liquid. The heat transfer member may include a first heat conduction region and a second heat conduction region that are alternately provided in a form of stripes on a surface of the heat transfer member that contacts the liquid. A first thermal conductivity of the first heat conduction region may be greater than a second thermal conductivity of the second heat conduction region. The heat transport system may include a liquid supply port to supply the liquid to the surface of the heat transfer member that contacts the liquid. The heat transport system may include a container to accommodate the liquid and permit the liquid to boil. The heat transport system may include a gas discharge port to discharge, from the container, a gas that is generated based on boiling of the liquid. The heat transport system may include a condenser that includes a gas condensing container, a gas supply port through which the gas is supplied to the gas condensing container, and a liquid discharge port through which another liquid, in which the gas is condensed, is discharged from the gas condensing container. The heat transport system may include a liquid flow path that links the liquid discharge port of the condenser and the liquid supply port of the heat exchanger. The heat transport system may include a gas flow path that links the gas discharge port of the heat exchanger and the gas supply port of the condenser.

A temperature of the first heat conduction region in the heat exchanger may be configured to be greater than a boiling point of the liquid, at a pressure inside the heat exchanger, and a temperature difference between the temperature of the first heat conduction region and the boiling point of the liquid is configured to be greater than or equal to 10° C.

A temperature difference between the temperature of the first heat conduction region in the heat exchanger and the boiling point of the liquid at the pressure inside the heat exchanger is configured to be less than or equal to 50° C.

The liquid may be at least one of water or a fluorine-based solvent.

The heat source may be a gas.

According to the heat exchanger of the present disclosure, it is possible to control bubbles generated due to boiling, and particularly, it is possible to facilitate boiling and improve a coefficient of heat transfer from a heat source to a heat medium accordingly. Therefore, the heat transfer coefficient of the heat exchanger of the present disclosure is higher than that in the related art.

The heat transport system using the heat exchanger of the present disclosure described above can transport heat of the heat medium to other places with high efficiency.

BRIEF DESCRIPTION OF THE DRAWINGS

Features, advantages, and technical and industrial significance of example embodiments will be described below with reference to the accompanying drawings, in which like numerals may denote like elements, and wherein.

DETAILED DESCRIPTION

Figure 1A:
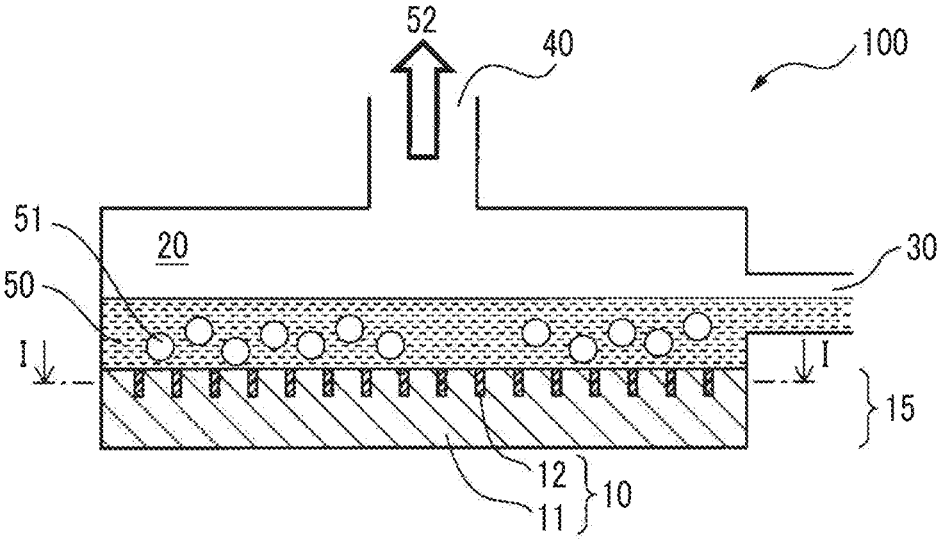
FIG. 1A is a schematic sectional view of a heat exchanger of an example embodiment of the present disclosure.

A heat exchanger of an example embodiment of the present disclosure is a heat exchanger configured to perform heat exchange by boiling a liquid based on heat transfer from a heat source to the liquid through a heat transfer member. A first heat conduction region (e.g., a high heat conduction region) and a second heat conduction region (e.g., a low heat conduction region) are alternately provided in a form of stripes on a surface, of the heat transfer member, that contacts a liquid to permit the liquid to boil based on contacting the heat transfer member.

Example embodiments of the heat exchanger of the present disclosure will be described below.

<Heat Exchanger>

A heat exchanger of an example embodiment performs heat exchange, through a heat transfer member, by permitting boiling of a liquid based on heat transfer from a heat source to the liquid that is serving as a heat medium. A first heat conduction region and a second heat conduction region, of the heat transfer member of the heat exchanger, are alternately provided in a form of stripes on a surface on the heat transfer member that contacts a liquid to permit the liquid to boil. As used herein, a surface region in which the first heat conduction region and the second heat conduction region are alternately provided in a form of stripes within the heat transfer member may be referred to as a boiling surface.

[Heat Transfer Member]

The heat transfer member of the heat exchanger of an example embodiment has a boiling surface that contacts a liquid, serving as a heat medium, to permit the liquid to boil. In the heat transfer member, it may be desirable for a proportion, of an area of the boiling surface as compared to the entire area of the surface of the heat transfer member that contacts a liquid, to be as large as possible to improve heat exchange efficiency and stabilize boiling of the liquid. As such, the proportion, of the area of the boiling surface as compared to the entire area of the surface of the heat transfer member that contacts the liquid, may be, as examples, greater than or equal to 80%, greater than or equal to 90%, greater than or equal to 95%, 100%, and/or the like.

The heat transfer member includes the boiling surface that contacts the liquid. The size, the shape, and/or the like, of the heat transfer member may be appropriately set according to a size of the heat exchanger, properties of a heat source to be used, and/or the like. The shape of the heat transfer member may be, for example, a disc shape, a pipe shape, a circular shape, and/or the like.

A material of the heat transfer member may be the same as a material of the first heat conduction region, and may be different than a material of the second heat conduction region. A material of the second heat conduction region and a material of the first heat conduction region are described below.

[Boiling Surface]

On the boiling surface of the heat transfer member in the heat exchanger of an example embodiment, the first heat conduction region and the second heat conduction region are alternately provided in a form of stripes. For example, the boiling surface of the heat transfer member may include alternating portions of the first heat conduction region and the second heat conduction region, thereby forming a striped pattern.

As described elsewhere herein, the boiling surface may include alternating portions of a first material associated with the first heat conduction region and a second material associated with the second heat conduction region. In this way, the boiling surface may include a substantially striped pattern based on the alternating portions of the first material and the second material. Put another way, the pattern of the boiling surface may include a portion of a first material interposed between portions of a second material. In this way, and as described elsewhere herein, the generation of bubbles may be controlled based on the pattern of the boiling surface, and the position of the first material as compared to the second material.

While some example embodiments herein describe the boiling surface as having a striped pattern, it should be understood that many other types of patterns may be used. For example, other example embodiments may include any type of pattern that interposes the first material and the second material. As non-limiting examples, other example embodiments may include circular patterns, wave patterns, square patterns, or any other type of geometric pattern.

(First Heat Conduction Region)

The first heat conduction region may be comprised of a first heat conductive material having a high thermal conductivity. The thermal conductivity of the first heat conductive material may be, for example, greater than or equal to 100 watts per meter-kelvin (W/mK), 200 W/mK, 250 W/mK, 300 W/mK, 350 W/mK, and/or the like, to increase the heat transfer coefficient. Additionally, or alternatively, and to reduce cost, the thermal conductivity of the first heat conductive material may be, for example, less than or equal to 5,000 W/mK, 3,000 W/mK, 1,000 W/mK, 500 W/mK, 400 W/mK, and/or the like.

The first heat conductive material may be, for example, a carbon-based material, a metal, a semimetal, and/or the like. The carbon-based material may be, for example, a carbon nanotube, diamond, artificial graphite, and/or the like. The metal may be, for example, silver, copper, gold, aluminum, and/or the like, and may be, for example, an alloy. The semimetal may be, for example, silicon, tin, graphite, and/or the like.

In the heat exchanger of an example embodiment, the diameter of bubbles generated based on the boiling of a liquid, serving as a heat medium, may be controlled by the width of stripes of the first heat conduction region. Therefore, as the width of the stripes of the first heat conduction region, it is desirable to select and set a width that permits bubbles with a certain diameter to be stably generated.

In an example embodiment, a value of the width of a stripe of the first heat conduction region (e.g., a high heat transfer region) can be estimated based on the following Fritz equation that associates surface tension and buoyancy of bubbles:

$$d=0.209\theta\cdot[\sigma/\{g(\rho_l-\rho_g)\}]^{1/2}$$

That is, when a value of a surface tension $\sigma$ of a liquid used as a heat medium, a value of a contact angle $\theta$ on a boiling surface of the liquid, a value of a density $\rho_l$ of the liquid, a value of a density $\rho_g$ of a gas when the liquid boils, and the value of gravitational acceleration g are assigned to the Fritz equation shown above, the diameter of a bubble, having a buoyancy commensurate with the surface tension may be estimated. In other words, the diameter d of a bubble, that detaches from the boiling surface of the heat transfer member, may be estimated.

In association with the heat exchanger of an example embodiment, the heat transfer coefficient of the heat exchanger may be improved when the width of stripes of the first heat conduction region of the boiling surface is set to a value that is equal to or the value, or within a threshold of the value, of the detaching bubble diameter d determined by the Fritz equation shown above.

Because the value of the detaching bubble diameter d determined according to the Fritz equation varies depending on a type of a liquid used as a heat medium, a type of the first heat conductive material of the boiling surface, heat exchange conditions, and/or the like, the width of the stripes of the first heat conduction region may vary.

When heat exchange is performed at a normal pressure (e.g., one standard atmosphere), the width of the stripe of the first heat conduction region may be, for example, greater than or equal to 1.0 mm, 1.2 mm, 1.4 mm, 1.6 mm, 1.8 mm. Additionally, or alternatively, the width of the stripe may be, for example, less than or equal to 10.0 mm, 9.5 mm, 9.0 mm, 8.5 mm, and/or the like.

A high heat transfer coefficient may be exhibited when a heat medium that is generally used in a heat exchanger that uses boiling latent heat, for example, water, a fluorine-based solvent, and/or the like, is used, and the width of the stripes of the first heat conduction region is set to a value between 2.5 mm and 7.5 mm, inclusive. The width of the stripes of the first heat conduction region may be, for example, greater than or equal to 2.6 mm, 2.7 mm, 2.8 mm, 2.9 mm, 3.0 mm, and/or the like. Additionally, or alternatively, the width of the stripes may be, for example, less than or equal to 7.0 mm, 6.0 mm, 5.0 mm, 4.5 mm, 4.0 mm, and/or the like.

The width of the stripes of the first heat conduction region, constituting the boiling surface of the heat exchanger of an example embodiment, may be substantially the same on the entire boiling surface to permit stable boiling and a high heat transfer coefficient, thereby increasing heat exchange efficiency.

(Second Heat Conduction Region)

The second heat conduction region may be made of a second heat conductive material having a lower thermal conductivity value than as compared to a thermal conductivity value of the first heat conductive material. The thermal conductivity value of the second heat conductive material may be 0.02, 0.01, 0.005, and/or the like, times the thermal conductivity value of the first heat conductive material.

The thermal conductivity value of the second heat conductive material may be, for example, less than or equal to 10 W/mK, 5 W/mK, 3 W/mK, 1 W/mK, 0.5 W/mK, 0.3 W/mK, and/or the like. Alternatively, the thermal conductivity value of the second heat conductive material may be, for example, greater than or equal to 0.025 W/mK, 0.03 W/mK, 0.04 W/mK, 0.05 W/mK, and/or the like, to reduce deterioration of the second heat conduction region.

The second heat conductive material may be exposed to temperatures equal to or greater than a boiling point of a liquid used as a heat medium at a pressure inside the heat exchanger. Therefore, it is desirable to have sufficient durability at such temperatures. In this respect, a softening temperature or a glass-transition temperature of the second heat conductive material is preferably greater than 120° C., 150° C. and/or the like, such as in situations where water is used as a heat medium and an operation is performed at a normal pressure with a degree of superheating that is set to 20° C.

The second heat conductive material that exhibits such a low thermal conductivity and high heat resistance may be, for example, a glass, a metal, a semimetal oxide, wood, a natural resin, a synthetic resin, and/or the like. The glass may be, for example, soda lime glass, borosilicate glass, quartz glass, and/or the like. The metal or semimetal oxide may be, for example, a crystal, gallium, ytterbium, and/or the like. The synthetic resin may be, for example, polyethylene, polypropylene, an epoxy resin, a silicone, and/or the like.

The width of the stripes of the second heat conduction region in the heat exchanger of an example embodiment may be, for example, greater than or equal to 0.01 mm, 0.02 mm, 0.04 mm, 0.06 mm, 0.08 mm, and/or the like. In this way, a difference between heat transferability of the second heat conduction region and heat transferability of the first heat conduction region may be obtained, and more efficient control of the diameter of boiling bubbles according to the stripes of the first heat conduction region may be obtained. Alternatively, the width of the stripes of the second heat conduction region may be, for example, less than or equal to 2.0 mm, 1.8 mm, 1.6 mm, 1.4 mm, 1.2 mm, and/or the like, to reduce deterioration of the boiling surface and to improve efficiency of heat exchange.

When a heat medium such as water, a fluorine-based solvent, and/or the like, is used, the width of the stripes of the second heat conduction region may be, for example, greater than or equal to 0.1 mm, 0.2 mm, 0.3 mm, and/or the like. Additionally, or alternatively, the width of the stripes may be, for example, less than or equal to 1.0 mm, 0.8 mm, 0.6 mm, and/or the like.

The width of the stripes of the second heat conduction region, constituting the boiling surface in the heat exchanger of an example embodiment, may be substantially the same on the entire boiling surface to permit improved heat exchange efficiency and stable boiling of the liquid.

The second heat conduction region may be comprised of a second heat conductive material, that is different than the first heat conductive material of the first heat conduction region, that is embedded within the boiling surface of the heat transfer member, thereby permitting a difference in heat transferability between the first heat conduction region and the second heat conduction region to be obtained. The embedding depth of the second heat conductive material, in the second heat conduction region, may be, for example, greater than 0.1 mm, 0.2 mm, 0.3 mm, and/or the like, as a distance from the boiling surface in the heat transfer member. Additionally, or alternatively, the depth of the second heat conduction region may be, for example, less than or equal to 1.0 mm, 0.8 mm, 0.6 mm, and/or the like, to improve the heat transfer coefficient.

(Shape of Boiling Surface)

The boiling surface may have a smooth planar shape. Alternatively, the boiling surface may have a non-planar shape having a surface with grooves, irregularities, and/or the like. When the boiling surface has both a striped structure including the first heat conduction region and the second heat conduction region described above, and a non-planar structure including grooves and/or other irregularities, a heat transfer coefficient may be improved.

[Other Components of Heat Exchanger]

Other components of a heat exchanger of an example embodiment, other than the heat transfer member described above, may be the same as those in known heat exchangers.

The heat exchanger of an example embodiment may comprise, for example, a liquid supply port through which a liquid, serving as a heat medium, is supplied to a boiling surface, a container in which the liquid is accommodated and boils, and a gas discharge port through which a gas generated due to boiling of the liquid is discharged from the container.

Figure 1B:
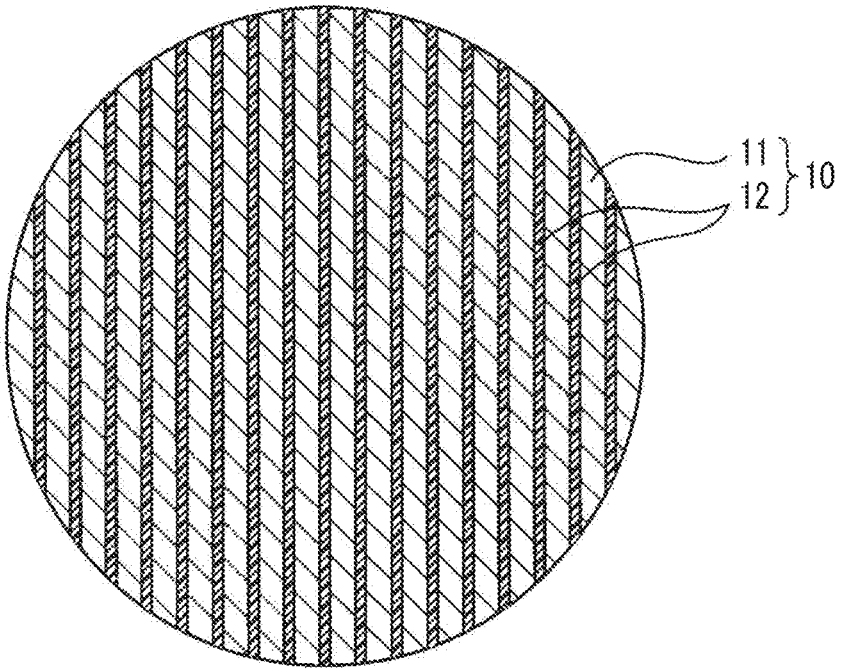
FIG. 1B is a sectional view of the heat exchanger taken along the line I-I shown in FIG. 1A.

FIGS. 1A and 1B show an example configuration of the heat exchanger of an example embodiment. FIG. 1A is a sectional view of a heat exchanger 100 taken along a vertical plane, and FIG. 1B is a sectional view taken along the line I-I shown in FIG. 1A.

The heat exchanger 100 shown in FIGS. 1A and 1B includes a heat transfer member 15, a liquid supply port 30, a container 20, and a gas discharge port 40. As used herein, the container 20 may be a chamber that is partitioned by surrounding partitioning walls. Alternatively, the container 20 may not include partitions.

The heat transfer member 15 has a configuration in which a second heat conduction region 12 is embedded in a material of a first heat conduction region 11. As such, the side of the heat transfer member 15, that contacts a liquid 50, constitutes a boiling surface 10 in which the first heat conduction region 11 and the second heat conduction region 12 are alternately provided in a form of stripes. For example, as shown in FIGS. 1A and 1B, the first heat conduction region 11 and the second heat conduction region 12 may form a striped pattern based on the boiling surface of the heat transfer member 15.

The liquid 50, serving as a heat medium, is supplied to the boiling surface 10 of the heat transfer member 15 through the liquid supply port 30. The liquid 50 boils on the boiling surface 10 due to heat transfer from a heat source through the heat transfer member 15, and bubbles 51 having diameters that are controlled by the striped structure of the boiling surface 10 are generated. The bubbles 51 rise in the liquid 50 towards the gas discharge port 40, become vapor 52 in a gas phase in the container 20, and are discharged from the gas discharge port 40.

<Heat Exchange Method>

A heat exchange method of an example embodiment may be performed using the heat exchanger of an example embodiment described above. The temperature of the first heat conduction region in the heat exchanger may be greater than the boiling point of the liquid, serving as a heat medium, at a pressure inside the heat exchanger. A temperature difference between the temperature of the first heat conduction region and the boiling point of the liquid at a pressure inside the heat exchanger may be, for example, greater than or equal to 10° C., 15° C., 20° C., and/or the like. Additionally, or alternatively, the temperature difference may be, for example, less than or equal to 50° C., 45° C., 40° C., and/or the like.

The liquid serving as a heat medium may be, for example, water, a fluorine-based solvent, ammonia, acetone, methanol, and/or the like.

The heat source may be a gas, a liquid, or a solid, a combination thereof, and/or the like. The gas may be, for example, air, water vapor, ammonia, fluorocarbons, carbon dioxide, and/or the like. The liquid may be, for example, water, brine, an oil, Dowtherm® A (registered trademark of the Dow Chemical Company), and/or the like. The solid may be, for example, a solid component capable of heating the liquid medium. Additionally, or alternatively, an air cooler for cooling waste heat may be used.

A gas may be used as the heat source in the heat exchange method of an example embodiment.

According to some possible example embodiments, any type of gas may be used as a heat source. Additionally, the heat source may be, for example, exhaust gas that is discharged from an internal combustion engine, exhaust gas that is discharged from a boiler, hot water that is discharged from a factory facility, and/or the like.

In a heat exchange method of an example embodiment, the heat source may be circulated to permit contact with a surface of the heat transfer member 15 that does not contact the liquid 50 in the heat exchanger 100 shown in FIGS. 1A and 1B. In this way, heat of the heat source can be transferred to the liquid 50 through the heat transfer member 15.

<Heat Transport System>

A heat transport system of an example embodiment includes the heat exchanger of an example embodiment described above, a condenser including a gas condensing container, a gas supply port through which a gas is supplied to the gas condensing container, and a liquid discharge port through which a liquid, in which a gas is condensed, is discharged from the gas condensing container, a liquid flow path that links the liquid discharge port of the condenser and the liquid supply port of the heat exchanger, and a gas flow path that links the gas discharge port of the heat exchanger and the gas supply port of the condenser.

Figure 2:
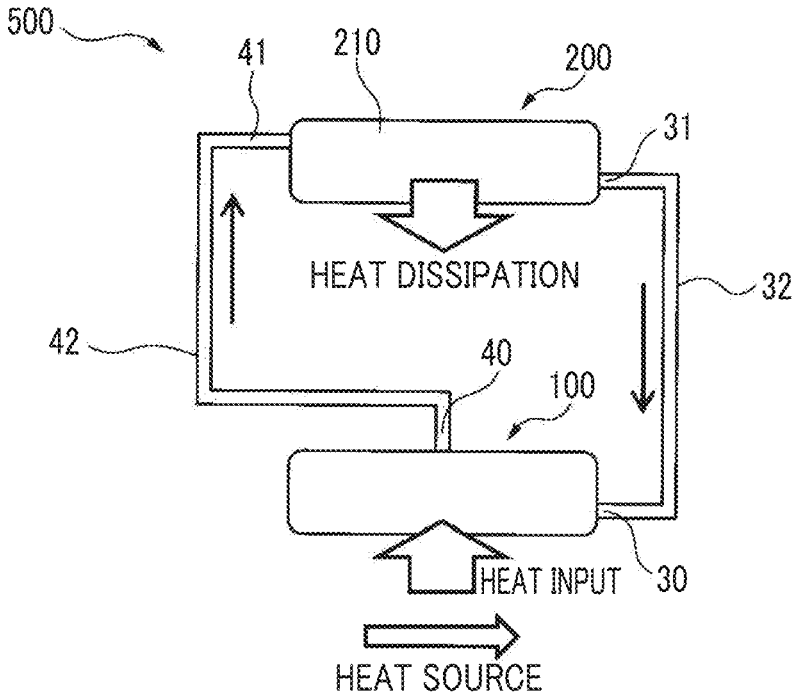
FIG. 2 is a schematic view of a heat transport system of an example embodiment of the present disclosure.

FIG. 2 is a schematic view of the heat transport system of an example embodiment.

A heat transport system 500 in FIG. 2 includes a heat exchanger 100, a condenser 200, a liquid flow path 32, and a gas flow path 42.

The condenser 200 includes a gas condensing container 210, a gas supply port 41 through which a gas is supplied to the gas condensing container 210, and a liquid discharge port 31 through which a liquid, in which a gas is condensed, is discharged from the gas condensing container 210. The liquid flow path 32 links the liquid discharge port 31 of the condenser 200 and the liquid supply port 30 of the heat exchanger 100. The gas flow path 42 links the gas discharge port 40 of the heat exchanger 100 and the gas supply port 41 of the condenser 200.

<Heat Transport Method>

A heat transport method of an embodiment is performed using the heat transport system of an example embodiment described above, and the temperature of the first heat conduction region in the heat exchanger may be controlled such that it is a temperature 10° C. to 50° C. greater than the boiling point of the liquid serving as a heat medium at a pressure inside the heat exchanger. The temperature of the first heat conduction region in the heat exchanger may be set to be a higher temperature than the boiling point of the liquid serving as a heat medium at a pressure inside the heat exchanger. A temperature difference between the temperature of the first heat conduction region and the boiling point of the liquid at a pressure inside the heat exchanger may be, for example, greater than or equal to 10° C., 15° C., 20° C., and/or the like. Additionally, or alternatively, the temperature difference may be, for example, less than or equal to 50° C., 45° C., 40° C., and/or the like.

The liquid serving as a heat medium, and the heat source used in the heat transport method of an example embodiment may be the same as those described above.

In order to ascertain effects of the heat exchanger of an example embodiment, an experimental device, having a plate resembling the boiling surface of the heat exchanger, was evaluated.

Figure 3:
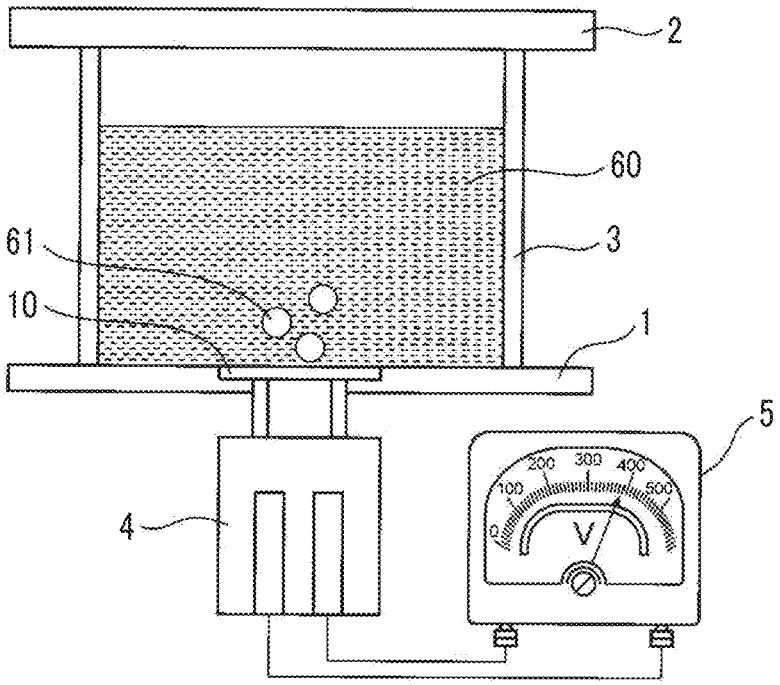
FIG. 3 is a schematic diagram of an experimental device.

FIG. 3 shows an overview of a configuration of the experimental device. The experimental device in FIG. 3 includes a water tank 3 having a bottom plate 1, a lid 2, and a boiling surface 10. As an example, the inner diameter of the water tank 3 is 100 mm, and the diameter of the boiling surface 10 is 40 mm. The boiling surface 10 is connected to a heater 4 and exposed to an inner side surface of the water tank 3 of the bottom plate 1. The heater 4 is operated by a power supply 5. Water 60 which is a liquid serving as a heat medium is filled into the water tank 3. When the water 60 is heated by the heater 4 through the boiling surface 10, the water 60 boils on the boiling surface 10 and bubbles 61 are generated.

Comparative Example 1

The boiling surface 10 was a copper mirror surface, the temperature of superheating ΔTsat of the boiling surface 10 was set to 30° C., and a boiling experiment was performed at a normal pressure (e.g., one standard atmosphere).

A virtual straight line that extends vertically from a center of the boiling surface 10 and perpendicular to the boiling surface 10 was set as a guide for measurements. On the virtual straight line, four measurement points above the boiling surface 10 were set at different distances x from the boiling surface 10. The four measurement points were 2 mm, 4 mm, 6 mm, and 8 mm, respectively, above the boiling surface 10 along the virtual straight line. The temperatures T at the four measurement points were measured and a straight line of a temperature gradient dT/dx was obtained. A temperature, at a point of x=0 that was estimated by an extrapolation method using the obtained straight line, was set as a surface temperature Tw of the boiling surface 10.

A bulk water temperature T∞ of the water 60 in the water tank 3 was obtained as an average value of measured temperatures at two measurement points in the water tank 3.

Using the above values, a heat transfer coefficient h obtained by calculation of the following equation was set as a reference value "1" for relative comparison.

$$h=q/\Delta T$$

$$q=-\lambda dT/dx$$

λ: thermal conductivity of copper, 391 W/mK $$\Delta T=Tw-T\infty$$

The temperature of superheating ΔTsat was a difference between the surface temperature Tw of the boiling surface 10 and the vapor temperature Tsat, and was determined by the following equation:

$$\Delta Tsat=Tw-Tsat$$

Example 1

On one side surface of a copper plate having a diameter of 40 mm, grooves having a width of 0.5 mm and a depth of 0.5 mm and rectangular cross sections were formed in a form of stripes at a pitch of 2.0 mm using a milling technique.

A two-liquid curable epoxy resin was filled into the grooves formed above, curing at room temperature and post curing were sequentially performed, and a boiling surface 10 in which a copper region with a width of 1.5 mm and an epoxy resin region with a width of 0.5 mm were alternately provided in a form of stripes was formed. The thermal conductivity of the epoxy resin in the epoxy resin region was 0.1 W/mK.

A temperature of superheating ΔTsat of the boiling surface 10 was set to 30° C., a boiling experiment at a normal pressure was performed, and a heat transfer coefficient h was obtained in the same manner as in Comparative Example 1 except that the boiling surface 10 was used. The obtained heat transfer coefficient h was 0.65 as a relative value with respect to the heat transfer coefficient h in Comparative Example 1.

Examples 2 to 7

Boiling surfaces 10 having a form of stripes and a different width of a copper region were formed in the same manner as in Example 1 except that pitches of stripe grooves formed were changed as shown in Table 1.

A temperature of superheating ΔTsat of the boiling surface 10 was set to 30° C., a boiling experiment was performed at a normal pressure, and a heat transfer coefficient h was calculated in the same manner as in Comparative Example 1 except that the boiling surfaces 10 were used. The calculation results of the obtained heat transfer coefficient h are shown below in Table 1 and FIG. 4 as relative values with respect to the heat transfer coefficient h in Comparative Example 1.

TABLE 1

| | Structure of boiling surface | | | |
|---|---|---|---|---|
| | Pitch (mm) | Width of the first heat conduction region (mm) | Width of the second heat conduction region (mm) | Heat transfer coefficient h (relative value) |
| Comparative Example | | Mirror surface | | 1 |
| Example 1 | 2.0 | 1.5 | 0.5 | 0.65 |
| Example 2 | 3.0 | 2.5 | 0.5 | 2.24 |
| Example 3 | 4.0 | 3.5 | 0.5 | 2.35 |
| Example 4 | 5.0 | 4.5 | 0.5 | 1.94 |
| Example 5 | 6.0 | 5.5 | 0.5 | 1.71 |
| Example 6 | 7.0 | 6.5 | 0.5 | 1.35 |
| Example 7 | 8.0 | 7.5 | 0.5 | 1.12 |

Figure 4:
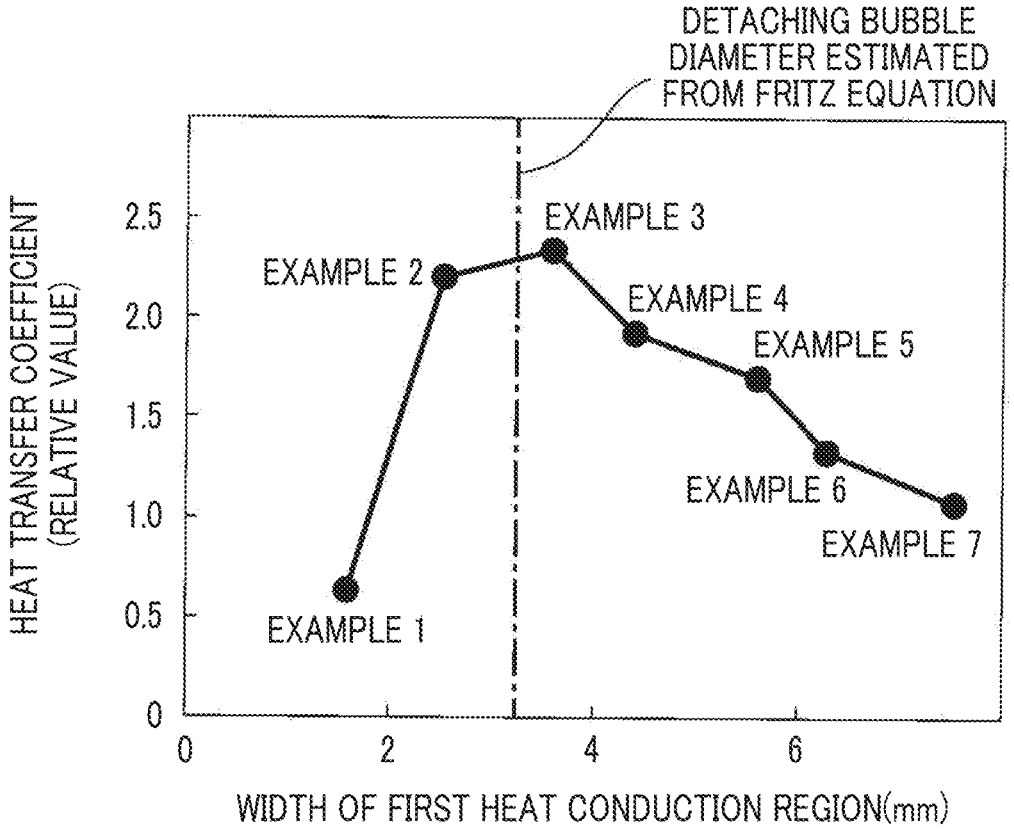
FIG. 4 is a graph showing the relationship between a width of a stripe of the first heat conduction region on a striped boiling surface and a heat transfer coefficient h in association with an example embodiment.

FIG. 4 shows values of the detaching bubble diameter d estimated from the Fritz equation described elsewhere herein. As shown in FIG. 4, the detaching bubble diameter d estimated from the Fritz equation was a value similar to the width of the first heat conduction region in Examples 2 and 3 in which a relatively high heat transfer coefficient was exhibited as compared to other examples.

FIGS. 5A through 5D show example images of bubbles that formed due to boiling of water on the boiling surface 10 over time in association with a configuration of Example 3. FIGS. 5A, 5B, 5C, and 5D show images that were captured in chronological order, and a time frame between the images was 10 milliseconds to 30 milliseconds. As shown in FIGS. 5A through 5D, the first heat conduction region corresponds to the set of stripes that includes the darker color and greater width than as compared to the other set of stripes, that corresponds to the second heat conduction region, having the lighter color and smaller widths.

Figure 5A:
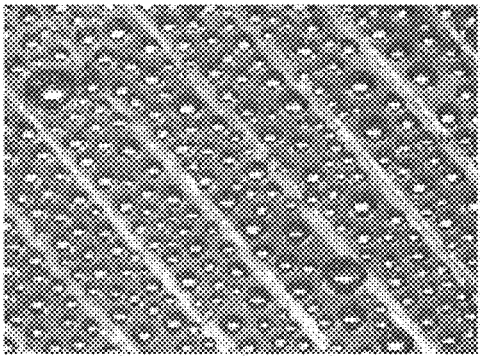
FIGS. 5A-5D are images of generated bubbles that formed due to boiling on a boiling surface over time in association with an example embodiment.
Figure 5B:
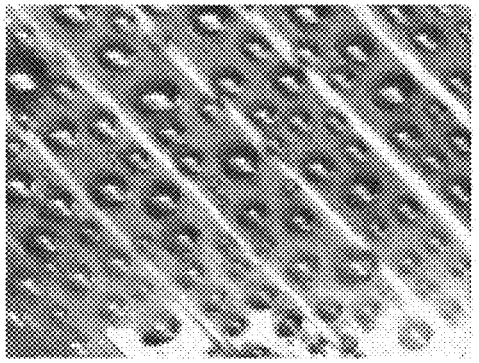
Figure 5C:
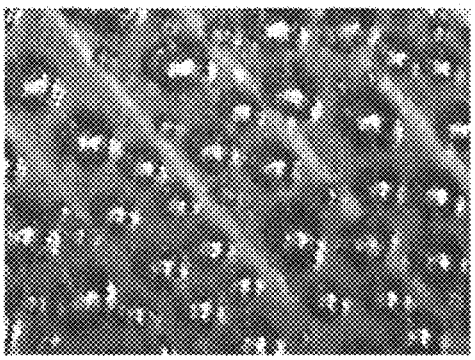
Figure 5D:
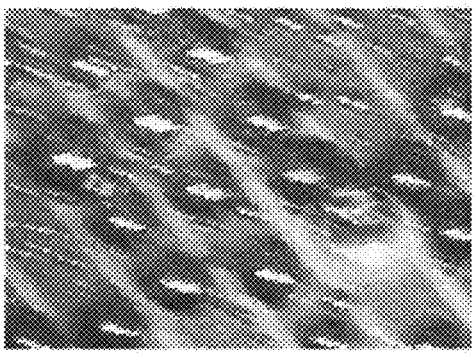

As shown in FIG. 5A, and as compared to FIGS. 5B through 5D, a greater number of bubbles, that include a smaller diameter, were generated. As further shown in FIG. 5A, fewer bubbles having a larger diameter were present as compared to FIGS. 5B through 5D. The relatively larger bubbles may correspond to a combination of bubbles having smaller diameters. As shown in FIGS. 5B and 5C, the diameters of the bubbles increased as compared to the bubbles shown in FIG. 5A. As further shown in FIGS. 5B and 5C, the diameters of the bubbles were smaller than the width of the stripes of the first heat conduction region. As shown, the diameters of bubbles exhibited substantial variation.

As shown in FIG. 5D, the diameters of bubbles further increased as compared to FIGS. 5A through 5C. As shown in FIG. 5D, some of the bubbles include diameters that are substantially equal to the width of the stripes of the first heat conduction region. In this way, the diameter of the generated bubbles was controlled by using the boiling surface having the striped pattern. In other words, the first heat conduction region controlled the bubbles that exhibited diameters that did not exceed the width of the stripes of the first heat conduction region and that exhibited minor variation. Control of the bubble diameter may have resulted from the structure of the boiling surface having a form of stripes in which the first heat conduction region and the second heat conduction region were alternately provided.

As shown in FIG. 5D, in addition to the larger bubbles having a diameter approximately the same as the width of the stripes of the first heat conduction region, bubbles with smaller diameters, and that were newly generated, were also observed.

As shown in FIGS. 5A through 5D, it should be understood that the positions at which bubbles are generated, diameters of the bubbles, the number of bubbles, and a generation frequency of bubbles may be controlled according to the heat exchanger of the present disclosure. Furthermore, and referring to FIG. 4, it should be understood that to the present disclosure may improve a heat transfer coefficient during heat exchange by appropriately controlling such parameters for bubbles.

What is claimed is:

1. A heat exchanger, comprising:

a heat transfer member interposed between a heat source and a liquid to permit heat exchange from the heat source to the liquid, wherein the heat transfer member comprises a first heat conduction region having a first surface and a second heat conduction region having a second surface that are alternately provided in a form of stripes, and the first surface and the second surface are coplanar and form a planar surface of the heat transfer member that is configured to contact the liquid, and a first thermal conductivity of the first heat conduction region is greater than a second thermal conductivity of the second heat conduction region.

2. The heat exchanger according to claim 1, wherein a width of a stripe of the first heat conduction region, on the planar surface of the heat transfer member, is between 2.5 millimeters (mm) and 7.5 mm.

3. The heat exchanger according to claim 1, wherein a width of a stripe of the second heat conduction region, on the planar surface of the heat transfer member, is between 0.1 millimeters (mm) and 1.0 mm.

4. The heat exchanger according to claim 1, wherein a value of the second thermal conductivity, of a second heat conductive material, of the second heat conduction region is less than 0.02 times another value of the first thermal conductivity, of a first heat conductive material, of the first heat conduction region.

5. The heat exchanger according to claim 1, wherein a softening temperature or a glass-transition temperature, of a second heat conductive material, of the second heat conduction region is equal to or greater than 120° C.

6. The heat exchanger according to claim 1, wherein the heat transfer member is comprised of a first heat conductive material, and the second heat conduction region is comprised of a second heat conductive material and is embedded in the planar surface of the heat transfer member that is configured to contact the liquid.

7. The heat exchanger according to claim 1, further comprising:

a liquid supply port to supply the liquid to the planar surface of the heat transfer member that is configured to contact the liquid;

a container to accommodate the liquid and permit the liquid to boil; and a gas discharge port to discharge, from the container, a gas that is generated based on boiling of the liquid.

8. A method, comprising:

performing, by a heat transfer member that is interposed between a heat source and a liquid, heat exchange from the heat source to the liquid, wherein the heat transfer member comprises a first heat conduction region having a first surface and a second heat conduction region having a second surface that are alternately provided in a form of stripes, and the first surface and the second surface and coplanar and form a planar surface of the heat transfer member that contacts the liquid, and a first thermal conductivity of the first heat conduction region is greater than a second thermal conductivity of the second heat conduction region.

9. The method according to claim 8, wherein a temperature of the first heat conduction region in a heat exchanger is greater than a boiling point of the liquid at a pressure inside the heat exchanger, and a temperature difference between the temperature of the first heat conduction region and the boiling point of the liquid is greater than or equal to 10° C.

10. The method according to claim 9, wherein the temperature difference between the temperature of the first heat conduction region in the heat exchanger and the boiling point of the liquid at the pressure inside the heat exchanger is less than or equal to 50° C.

11. The method according to claim 8, wherein the liquid is at least one of water or a fluorine-based solvent.

12. The method according to claim 8, wherein the heat source is a gas.

13. A heat transport system, comprising:

a heat exchanger comprising a heat transfer member that is interposed between a heat source and a liquid to permit heat exchange from the heat source to the liquid, wherein the heat transfer member comprises a first heat conduction region having a first surface and a second heat conduction region having a second surface that are alternately provided in a form of stripes, and the first surface and the second surface are coplanar and form a planar surface of the heat transfer member that contacts the liquid, and wherein a first thermal conductivity of the first heat conduction region is greater than a second thermal conductivity of the second heat conduction region;

a liquid supply port to supply the liquid to the planar surface of the heat transfer member that contacts the liquid;

a container to accommodate the liquid and permit the liquid to boil;

a gas discharge port to discharge, from the container, a gas that is generated based on boiling of the liquid;

a condenser that comprises a gas condensing container, a gas supply port through which the gas is supplied to the gas condensing container, and a liquid discharge port through which the liquid, in which the gas is condensed, is discharged from the gas condensing container;

a liquid flow path that links the liquid discharge port of the condenser and the liquid supply port of the heat exchanger; and a gas flow path that links the gas discharge port of the heat exchanger and the gas supply port of the condenser.

14. The heat transport system according to claim 13, wherein a temperature of the first heat conduction region in the heat exchanger is configured to be greater than a boiling point of the liquid, at a pressure inside the heat exchanger, and a temperature difference between the temperature of the first heat conduction region and the boiling point of the liquid is configured to be greater than or equal to 10° C.

15. The heat transport system according to claim 14, wherein the temperature difference between the temperature of the first heat conduction region in the heat exchanger and the boiling point of the liquid at the pressure inside the heat exchanger is configured to be less than or equal to 50° C.

16. The heat transport system according to claim 13, wherein the liquid is at least one of water or a fluorine-based solvent.

17. The heat transport system according to claim 13, wherein the heat source is a gas.

18. The heat exchanger according to claim 1, further comprising:

a liquid supply port to supply the liquid to the planar surface of the heat transfer member that contacts the liquid;

a container to accommodate the liquid and permit the liquid to boil;

a gas discharge port to discharge, from the container, a gas that is generated based on boiling of the liquid;

a condenser that comprises a gas condensing container, a gas supply port through which the gas is supplied to the gas condensing container, and a liquid discharge port through which the liquid, in which the gas is condensed, is discharged from the gas condensing container;

a liquid flow path that links the liquid discharge port of the condenser and the liquid supply port of the heat exchanger; and a gas flow path that links the gas discharge port of the heat exchanger and the gas supply port of the condenser.

* * * * *